US006708692B2

(12) United States Patent
Lee et al.

(10) Patent No.: US 6,708,692 B2
(45) Date of Patent: Mar. 23, 2004

(54) DEMAND FLOW CONTROL VALVE

(76) Inventors: Charles H. Lee, 6 Ensueno West, Irvine, CA (US) 92620; Richard L. Rosiello, 768 Knollwood La., San Dimas, CA (US) 91773

( * ) Notice: Subject to any disclaimer, the term of this patent is extended or adjusted under 35 U.S.C. 154(b) by 99 days.

(21) Appl. No.: 09/923,363

(22) Filed: Aug. 8, 2001

(65) Prior Publication Data

US 2003/0029450 A1 Feb. 13, 2003

(51) Int. Cl.[7] ..... A62B 9/02

(52) U.S. Cl. ..... 128/205.24; 128/204.18; 128/205.21; 128/205.24; 128/207.12

(58) Field of Search ..... 128/205.25, 205.24, 128/207.12, 204.26, 204.18, 206.15, 205.18, 203.21, 205.22

(56) References Cited

U.S. PATENT DOCUMENTS

| | | | | | |
|---|---|---|---|---|---|
| 3,976,063 | A | * | 8/1976 | Henneman et al. | 128/201.25 |
| 4,440,163 | A | | 4/1984 | Apergel | |
| 4,565,196 | A | | 1/1986 | Melby et al. | |
| 4,582,054 | A | | 4/1986 | Eweewe | |
| 4,669,462 | A | | 6/1987 | Marshall | |
| 4,802,472 | A | | 2/1989 | Jung | |
| 5,273,185 | A | * | 12/1993 | Sacarto | 222/5 |
| 5,301,665 | A | | 4/1994 | Jumpertz et al. | |
| 5,318,019 | A | | 6/1994 | Celaya | |
| 5,429,125 | A | | 7/1995 | Wagner et al. | |
| 5,438,981 | A | | 8/1995 | Starr et al. | |
| 5,488,946 | A | * | 2/1996 | Calhoun et al. | 128/205.21 |
| 5,529,058 | A | * | 6/1996 | Crippen | 128/201.28 |
| 5,537,999 | A | | 7/1996 | Dearman et al. | |
| 5,816,243 | A | | 10/1998 | Georgiou | |
| 6,041,778 | A | * | 3/2000 | Swann et al. | 128/201.25 |
| 6,155,258 | A | * | 12/2000 | Voege | 128/205.21 |
| 6,247,471 | B1 | | 6/2001 | Bower et al. | |
| 6,647,982 | B1 | * | 11/2003 | Zaiser et al. | 128/204.18 |

* cited by examiner

*Primary Examiner*—Weilun Lo
*Assistant Examiner*—Darwin P. Erezo

(57) ABSTRACT

An apparatus meant for human use to supplement breathing while at high altitude in aircraft for emergency use. The apparatus includes a valve as an actuator to discharge oxygen into an attached facemask. A small cylinder containing oxygen under pressure is inserted and attached to the valve. Once assembled, the invention is stored in aircraft to be available for instant use. If a cabin depressurization emergency should occur, an occupant may access oxygen immediately by pressing a valve lever to start the flow of oxygen. By adjusting a knob located on the valve lever the user may control the flow of oxygen and extend oxygen use to allow time for evasive action.

2 Claims, 3 Drawing Sheets

DEMAND FLOW CONTROL VALVE

BACKGROUND OF THE INVENTION

1. Field of the Invention

The invention relates to a small and portable oxygen dispenser for personal use to supplement breathing in emergency situations. One such scenario would be the depressurization of a private aircraft at high altitude.

2. Background of the Invention

The fatal crash of a private jet aircraft carrying a famous golfer, crew and passengers brought national attention to these types of emergency situations and left many questions unanswered as to what happened and why. The Federal Aviation Administration (F.A.A.) sighted Hypoxia (oxygen deprivation) as a possible cause. The effects of high altitude (lower barometric pressure) to the body may cause such symptoms as fatigue, lethargy, euphoria, giddiness and black out. The F.A.A. has attributed many past fatal and nonfatal aircraft accidents to this condition. If instant access to oxygen where available to pilots and passengers lives could be saved.

3. Discussion of Prior Art Work

In prior art other attempts have been made to provide an emergency supply of oxygen that is portable. Generally, these apparatuses are for escape from a burning structure such as a hotel or office building. The maximum output from the current valve sources is 100%, when on, or 0% when off, there is no in between. In a life-threatening situation, it may be necessary to extend the life of the oxygen available. In other words, have a way to accurately control the oxygen flow. Prior U.S. patented examples listed below:

U.S. Pat. Nos. 6,247,471; 5,301,665; 4,802,472; 4,669,462; 4,582,054; 4,565,196 and 4,440,163.

More specifically, U.S. Pat. No. 6,247,471 to Bower et al., June, 2001 shows a complicated device, which requires assembly. During this assembly period, the much needed oxygen supply is not available. This would especially hold true during any type of aircraft cabin depressurization. The time required to assemble the device could use up those precious seconds needed to fight the affects of hypoxia. U.S. Pat. No. 5,301,665 to Jumpertz, April, 1994 lacks being portable. To escape aircraft while still being able to access oxygen adds an extra margin of safety to help save ones life U.S. Pat. No. 4,802,472 to Jung, February 1989 a valve type that cannot accurately control the oxygen flow. Accurate control of oxygen flow increases time to life saving oxygen.

4. Objects and Advantages

Accordingly, several objects and advantages of the invention are to achieve a new invention for supplemental breathing at high altitude and use in aircraft during a depressurization emergency.

It is an object to provide oxygen instantly on demand in case of an emergency.

It is an object to have a variably controlled discharge rate to economize oxygen.

It is an object to contain oxygen under high pressure.

It is an object to regulate oxygen from a limited supply for over a ten-minutes.

It is an object to obtain visual indication of cylinder pressure.

It is an object to have an assembly that is lightweight, compact and portable.

It is an object to limit breakage or injury due to the valve discharge lever arm flip-over.

It is an object to guard against accidental discharge when transporting.

It is an object for the device to be economical to manufacture.

Further objects and advantages of the invention will become apparent from a consideration of the drawings and ensuing description.

LIST OF REFERENCE NUMERALS

Figure 1:
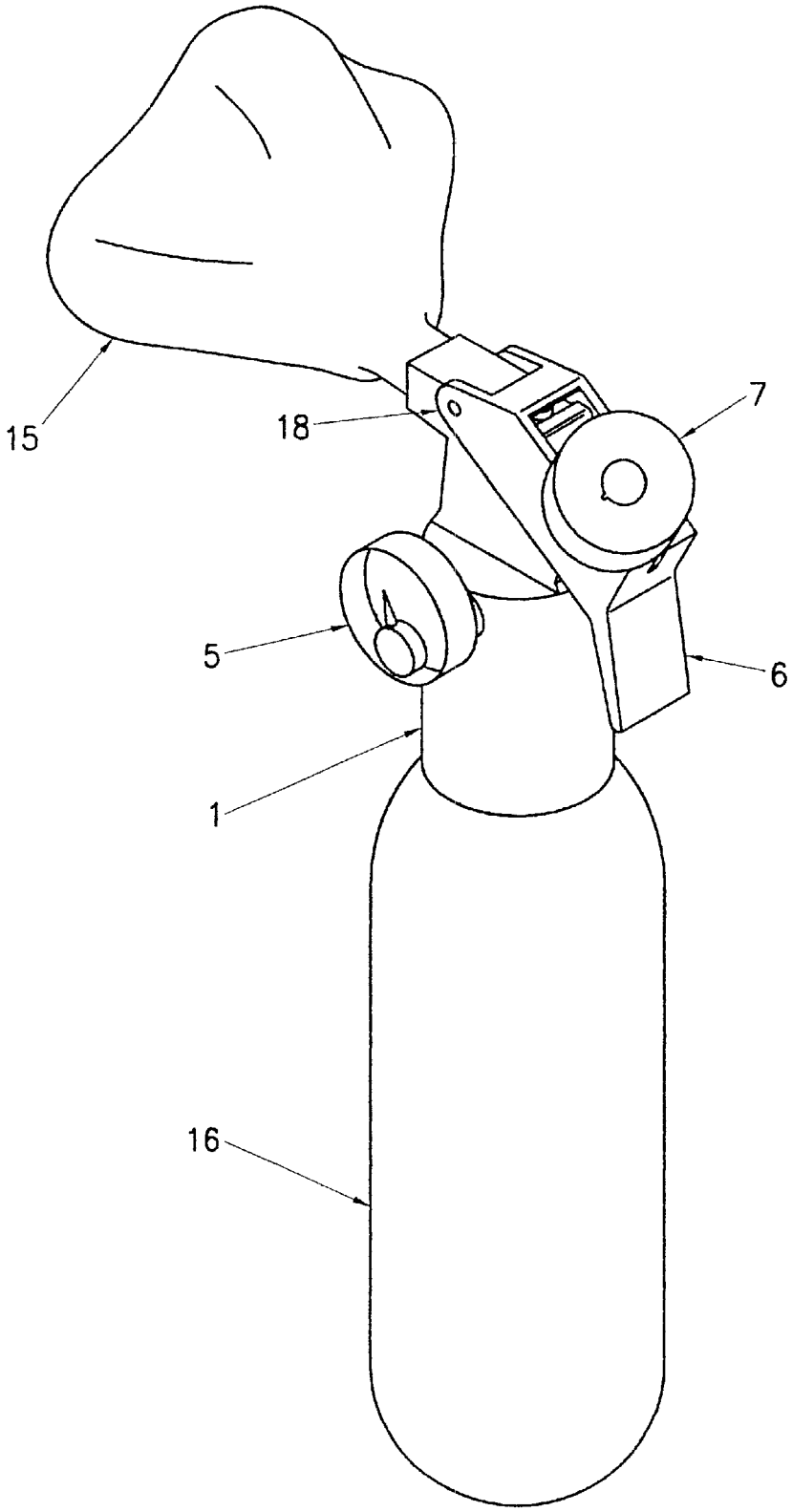
FIG. 1 is a perspective view of the assembled invention.

1. Valve body.
2. Exit nozzle
3. Lance
4. Pushpin
5. Pressure gauge
6. Lever arm
7. Knob
8. Stopper
9. Valve body O-ring
10. O-rings
11. Spring
12. Ball
14. Stopper Spring
15. Face Mask
16. Cylinder
17. Stop guide
18. Hinge pin
19. Safety vent
20. Cross-member
21. Channel
22. Stopper channel

SUMMARY OF THE INVENTION

The invention once assembled consists of an attached cylinder filled with aviation grade oxygen and an on-demand type valve with connected facemask. During a depressurizing emergency in the aircraft a passenger or pilot quickly grabs the assembly and instantly accesses oxygen by pressing a valve lever. Once oxygen flow is started a knob located on the lever is used to extend oxygen use. Further scope of the invention will become apparent from the detailed description given hereinafter.

BRIEF DESCRIPTION OF THE INVENTION

Referring to FIG. 1 shows a perspective view of an assembly having a Valve body 1, Facemask 15 and Cylinder 16. Pressured oxygen is feed to the mask by the Cylinder 16 attached at Valve body 1 base. A Hinge pin 18 connects a pivotal Lever arm 6 located on Valve body 1. The Lever arm 6 comprises of an adjusting mechanism accessed by the Knob 7 to accurately control pressure flow once started. A Pressure gauge 5 indicates Cylinder pressure.

DETAILED DESCRIPTION OF THE INVENTION

Figure 2:
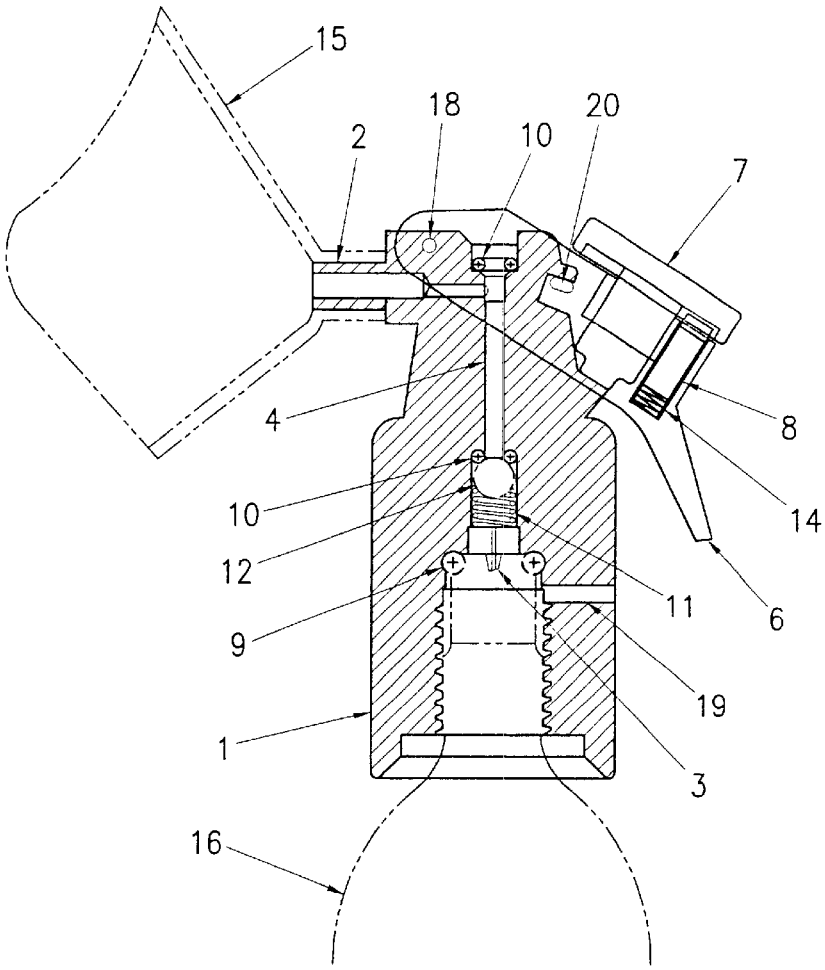
FIG. 2 shows a cross-sectional view of the Valve body.

Referring in detail to the illustrations and with particular reference to FIG. 2 the device uses an on-demand actuator Valve body 1 as the main component. A Facemask 15 is preferred to consume oxygen. An open nipple end of the Facemask 15 fits over Exit nozzle 2 and Exit nozzle supports Facemask to keep it pointed outward. The Facemask 15 is made of a flexible material such as plastic and tightly contours to users face.

A Lever arm 6 pivots on Hinge pin 18 and is mechanically linked to Pushpin 4, Ball 12 and Spring 11. Ball 12 is maintained to block passage by Spring 11, at rest valve will stay in a "valve closed" state. Down pressure on Pushpin 4 moves Ball 12 to unblock passage. Pushpin 4 easily slides in passage and is channeled or grooved lengthwise to allow oxygen flow. The O-rings 10 seal Pushpin 4 passage and are preferably made of neoprene.

Figure 2A:
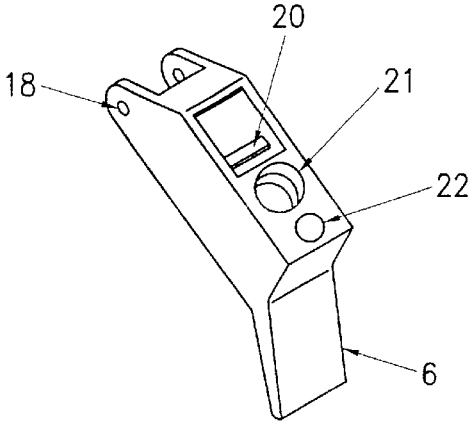
FIG. 2A shows an exploded view of the Lever arm.
Figure 2B:
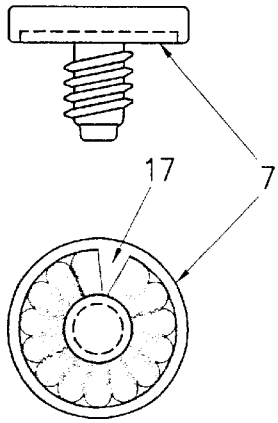
FIG. 2B shows exploded views of the Knob.

Now referring to FIG. 2B Knob 7 having a stem with male thread screws in Channel 21, FIG. 2A having a cylindrical portion with female thread. The underside surface of the Knob 7 is patterned symmetrically with slots or grooves. Referring to FIG. 2, Stopper 8 slides freely in cylindrical Channel 22, FIG. 2A. Stopper spring 14, FIG. 2 maintains the Stopper 8 in groove depth keeping Knob 7 stationary when not in use. When sufficient lateral pressure is exerted on Knob, stopper's holding power can be overcome. As Knob 7 rotates Stopper 8 impinges in and out of groove pattern with an audible click. Each click indicates a groove movement and each groove acts as a set degree. The discharge rate of oxygen (or other gases) can be set, by adjusting Knob 7 at any lever between maximum discharge to minimum (zero) discharge rate(s).

Certain steps are taken to deal with Lever arm 6 safety issues. Accidental discharge can occur with other valves while transporting. To approach this problem FIG. 2B shows Stop guide 17 that is a cusp or ridge included in groove pattern. The Stop guide 17 keeps Knob from screwing out of Lever arm 6 and is start/stop of pressure flow. Knob 7 may be set for transportation to maintain Lever arm 6 stationary "no accidental discharge may happen".

Some valves have problems caused by the Lever arm 6 flipping over 180 degrees to the other side. This can cause breakage or injury to user (can protrude at two inches outward) and hence, if stored in a pocket for instance, cause damage to clothing or injury to user when accessed. To approach this problem, in FIG. 2A shows Cross-member 20 fits inside the confines of a trihedral or U-shaped enclosure located on Valve body 1 and keeps Lever from flipping over. Lever arm safety features enhance the device use in high altitude activities like avalanche patrol and alpine sports.

Figure 3:
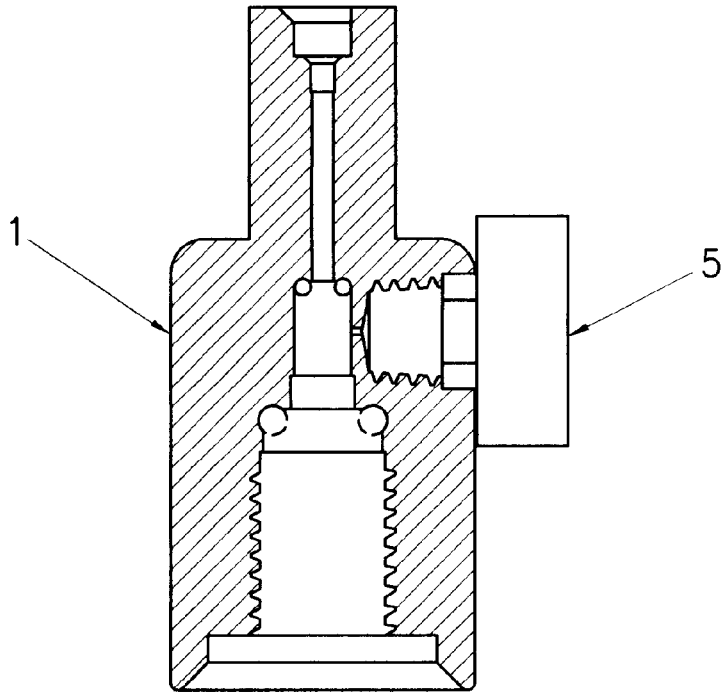
FIG. 3 shows pressure gauge location on Valve body.

FIG. 1 and FIG. 3 shows approximant Pressure gauge 5 location on Valve body 1. The preferred diameter on gauge face dial measures 23 mm and is magnified for easy reading. Referring now to FIG. 3 Gauge 5 stem (male portion) threads into Valve body 1 wall orifice (female portion). Preferred thread size used on both portions is ⅜ in.

Most aircraft cabins have small confines, which dictate a small size oxygen container. Nittan Inc. Batesville, Miss. manufactures the preferred container, an 18-liter disposable steel Cylinder 16, FIG. 1 approximately pressured to 3,400 psi. The cylinder contains "Aviators Breathable Oxygen". By economizing oxygen flow, cylinder contents will meet or exceed Federal regulation 14 CFR Part 91 Sec. 91.211. Referring now to FIG. 2, nipple or stem of Cylinder 16 is screwed clockwise into the opening located at Valve body 1 bottom or base. The stem and opening have male and female thread respectfully. Both use a preferred ⅝ in thread. The Cylinder 16 has a length of about 5 in and a width diameter of about 5½ in. During screwing, Lance 3 made of unyielding material pierces through upper top most portion of Cylinder 16. Lance is hollow and allows pressure to travel into Valve Body 1. Valve body O-ring 9 forms to tightly seal juncture. The O-ring is preferably made of neoprene. When Cylinder 16 is empty it may be screwed counterclockwise and replaced with a new one.

If Cylinder unscrews before emptied, a safety issue of uncontrolled thrusting may exist. Certain steps are taken to approach this problem. Referring to FIG. 2, Safety vent 19 is approximately placed through the Valve body 1. As Cylinder unscrews pressure escapes through vent with an auditable hiss. The effect both warns of danger and depletes pressure. Valve Body 1 and Cylinder 16 have long thread lengths. This delays separation to further Cylinder depletion. If separation occurs, diameter of Lance puncture is such as to limit Cylinder movement by restricting thrust.

While the above description contains specificity, these should not be construed as limitations on the scope of the invention, but rather as an exemplification of one preferred embodiment. Additional variations include for a fire extinguisher and a pneumatic inflator.

We claim:

1. A pocket size, personal use, breathing apparatus used for supplying continuous or on demand aviation oxygen to aircraft pilots and passengers or any other high elevation condition in a non-medical emergency situation, the apparatus comprising:

a mask for covering the mouth or nose of the user;

a pressurized gas container containing aviation oxygen; and a valve apparatus coupled to said gas container by threading action causing a hollow casted lance to pierce said gas container, said valve apparatus comprising:

means for indicating pressure;

a hinge pin secured on said valve apparatus;

a pivotable lever arm mounted on said hinge pin for dispensing the flow of oxygen from said gas container; and an adjustable control knob threadedly mounted on said lever arm for regulating the flow of oxygen from said gas container;

wherein the movement of said control knob regulates the flow of oxygen by limiting the movement of said lever arm, wherein said control knob is capable of locking said lever arm to prevent accidental discharge.

2. The apparatus as claimed in claim 1, wherein the mask comprises a pliable surface.

* * * * *